US009234400B2

(12) United States Patent
Warnock, Jr. et al.

(10) Patent No.: US 9,234,400 B2
(45) Date of Patent: Jan. 12, 2016

(54) SUBSEA PUMP SYSTEM

(75) Inventors: Roger Warnock, Jr., Houston, TX (US); Calum Maxwell Stirling, Aberdeen (GB); James Colley, Magnolia, TX (US); Alan William Doe, Lymington (GB)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 14/004,140

(22) PCT Filed: Mar. 8, 2012

(86) PCT No.: PCT/GB2012/050520
§ 371 (c)(1),
(2), (4) Date: Jan. 21, 2014

(87) PCT Pub. No.: WO2012/120307
PCT Pub. Date: Sep. 13, 2012

(65) Prior Publication Data

US 2014/0124211 A1 May 8, 2014

(30) Foreign Application Priority Data

Mar. 9, 2011 (GB) ..... 1104021.9

(51) Int. Cl.
*E21B 33/06* (2006.01)
*E21B 33/064* (2006.01)
*E21B 33/035* (2006.01)

(52) U.S. Cl.
CPC ..... *E21B 33/061* (2013.01); *E21B 33/0355* (2013.01); *E21B 33/06* (2013.01); *E21B 33/064* (2013.01)

(58) Field of Classification Search
CPC ..... E21B 33/0355; E21B 33/06; E21B 2034/002; E21B 2034/007; E21B 21/10; E21B 21/106; E21B 23/04
USPC ..... 166/344, 351, 363, 368, 87.1; 137/315.02; 251/1.1, 1.2, 1.3; 405/190, 405/191
See application file for complete search history.

(56) References Cited

U.S. PATENT DOCUMENTS 1,909,304 A * 5/1933 Mueller ..... E21B 33/062 166/86.3
2,139,525 A * 12/1938 Snell ..... E21B 33/062 251/1.3
2,139,526 A * 12/1938 Snell ..... E21B 33/062 137/492
2,194,254 A * 3/1940 King ..... E21B 33/062 137/629

(Continued)

FOREIGN PATENT DOCUMENTS

CA 1 239 090 7/1988
GB 1006168 9/1965

(Continued)

*Primary Examiner* — Matthew Buck
*Assistant Examiner* — Edwin Toledo-Duran
(74) *Attorney, Agent, or Firm* — Levy & Grandinetti

(57) ABSTRACT

A subsea pump system is adapted to close a hydraulic ram of a blowout preventer. The subsea pump system has at least a first pump and a second pump configured to pump drive fluid from a source to the hydraulic ram. The system has a controller configured to automatically select at least one of the first and second pumps for pumping the drive fluid wherein at least the first pump is selected at a lower fluid pressure range and at least the second pump is selected at a higher fluid pressure range. A method of operating a pump system and an intervention skid for a pump system are also described.

19 Claims, 3 Drawing Sheets

(56) References Cited

U.S. PATENT DOCUMENTS 2,282,363 A * 5/1942 King ..... E21B 33/062 251/1.3
2,388,755 A * 11/1945 McLeod ..... B60J 7/1273 137/493
2,855,172 A * 10/1958 Jones ..... E21B 33/062 251/1.3
2,872,940 A * 2/1959 Lewis ..... E21B 33/06 137/554
2,912,214 A * 11/1959 Allen ..... E21B 33/062 251/1.3
2,963,865 A * 12/1960 Thomas ..... A21C 11/16 60/371
2,972,863 A * 2/1961 Hyde ..... F04B 47/04 417/904
3,040,763 A * 6/1962 Bouvier ..... E21B 33/06 137/625.47
3,137,348 A * 6/1964 Ahlstone ..... E21B 7/128 166/208
3,142,337 A * 7/1964 Poorman, Jr. ..... E21B 33/0355 166/338
3,163,222 A * 12/1964 Foster ..... E21B 33/0355 137/554
3,164,034 A * 1/1965 Kelley ..... F16H 47/08 475/125
3,186,486 A * 6/1965 Rhodes ..... E21B 33/035 166/339
3,207,221 A * 9/1965 Cochran ..... E21B 33/06 166/85.4
3,274,780 A * 9/1966 Salna ..... B60K 17/10 60/429
3,338,302 A * 8/1967 Hubby ..... E21B 33/0355 166/351
3,503,443 A * 3/1970 Trageser ..... E21B 33/037 114/257
3,602,303 A * 8/1971 Blenkarn ..... E21B 33/076 166/360
3,620,134 A * 11/1971 Conlon ..... F04B 1/02 222/390
3,894,824 A * 7/1975 Wells ..... B29C 45/82 425/146
3,921,500 A * 11/1975 Silcox ..... E21B 33/064 166/338
4,095,421 A * 6/1978 Silcox ..... E21B 33/0355 137/236.1
4,184,331 A * 1/1980 Bentley ..... F15B 11/17 417/900
4,214,605 A * 7/1980 Hardgrave ..... E21B 33/062 137/495
4,349,041 A * 9/1982 Bates ..... E21B 33/06 137/1
4,413,642 A * 11/1983 Smith ..... E21B 34/16 137/102
4,509,405 A * 4/1985 Bates ..... E21B 33/06 251/1.2
4,614,148 A * 9/1986 Bates ..... E21B 33/06 251/1.1
4,688,633 A * 8/1987 Barkley ..... E21B 33/03 166/341
4,833,971 A * 5/1989 Kubik ..... B30B 15/161 60/428
4,877,217 A * 10/1989 Peil ..... E21B 34/16 251/1.3
4,938,290 A * 7/1990 Leggett ..... E21B 33/08 166/387
4,953,458 A * 9/1990 Day ..... B30B 1/323 100/214
4,986,511 A * 1/1991 Irby ..... E21B 33/06 251/1.1
5,033,206 A * 7/1991 Corner ..... C14B 1/58 34/144
5,044,602 A * 9/1991 Heinonen ..... E21B 33/06 166/84.1
5,273,376 A * 12/1993 Ritter, Jr. ..... E21B 41/04 405/169
5,400,857 A * 3/1995 Whitby ..... E21B 29/08 166/297
5,404,943 A * 4/1995 Strawn ..... E21B 43/121 166/105
5,505,426 A * 4/1996 Whitby ..... E21B 33/063 251/1.1
5,682,742 A * 11/1997 Sato ..... B30B 15/20 100/269.05
5,735,502 A * 4/1998 Levett ..... E21B 33/062 251/1.1
5,782,304 A * 7/1998 Garcia-Soule ..... E21B 23/006 166/320
5,819,851 A * 10/1998 Dallas ..... E21B 17/1007 166/308.1
5,875,841 A * 3/1999 Wright ..... E21B 33/062 137/614.19
5,884,707 A * 3/1999 Garcia-Soule ..... E21B 23/006 166/320
5,884,708 A * 3/1999 Garcia-Soule ..... E21B 23/006 166/320
6,024,172 A * 2/2000 Lee ..... E21B 33/06 166/363
6,202,753 B1 * 3/2001 Baugh ..... E21B 33/0355 166/364
6,223,819 B1 * 5/2001 Heinonen ..... E21B 33/068 166/368
6,394,460 B1 * 5/2002 Leggett ..... E21B 33/062 277/324
6,688,392 B2 2/2004 Shaw
6,814,140 B2 * 11/2004 Robichaux ..... E21B 19/002 166/339
6,840,088 B2 1/2005 Tucker et al.
6,904,982 B2 6/2005 Judge et al.
7,000,888 B2 * 2/2006 Wright ..... E21B 33/062 251/1.1
7,108,069 B2 * 9/2006 Killie ..... E21B 33/0355 166/336
7,134,498 B2 * 11/2006 Hopper ..... B01D 17/00 166/267
7,300,033 B1 * 11/2007 Whitby ..... E21B 33/062 166/85.4
7,374,146 B2 * 5/2008 Whitby ..... E21B 33/062 166/85.4
7,387,166 B2 * 6/2008 Bartlett ..... E21B 33/043 166/335
7,395,864 B2 * 7/2008 Ramachandran ..... C09K 8/52 137/13
7,481,270 B2 1/2009 Shepler
7,549,476 B2 * 6/2009 Carlsen ..... E21B 33/076 166/344
8,205,678 B1 * 6/2012 Milanovich ..... E21B 33/064 166/339
8,220,553 B2 * 7/2012 Crawford ..... E21B 33/072 166/241.5
8,459,019 B2 * 6/2013 Hohensee ..... F04B 27/067 604/430
8,490,705 B2 * 7/2013 Curtiss, III ..... E21B 47/0001 166/250.1
8,511,389 B2 * 8/2013 Fenton ..... E21B 33/0355 166/250.01
8,622,139 B2 * 1/2014 Herbel ..... E21B 29/08 137/315.02
8,651,189 B1 * 2/2014 Milanovich ..... E21B 43/0122 166/335
2003/0178200 A1 * 9/2003 Fox ..... E21B 7/124 166/341
2003/0217848 A1 * 11/2003 Shaw ..... E21B 43/12 166/366
2004/0007392 A1 * 1/2004 Judge ..... E21B 21/001 175/206
2006/0042799 A1 * 3/2006 Hosie ..... E21B 33/035 166/338
2006/0162934 A1 * 7/2006 Shepler ..... E21B 17/01 166/370
2007/0289746 A1 * 12/2007 Fossli ..... E21B 21/001 166/363
2008/0078965 A1 * 4/2008 Lane ..... E21B 33/062 251/1.3

(56) References Cited

U.S. PATENT DOCUMENTS

2009/0127482 A1* 5/2009 Bamford ..... E21B 33/063 251/1.3
2010/0107622 A1* 5/2010 Hohensee ..... 60/327
2010/0155071 A1* 6/2010 Gustafson ..... E21B 33/0355 166/335
2011/0005770 A1* 1/2011 Scranton ..... E21B 34/045 166/363
2011/0147002 A1* 6/2011 Kotrla ..... E21B 33/0355 166/363
2011/0266003 A1* 11/2011 Singh et al. ..... E21B 33/064 166/368
2012/0217020 A1* 8/2012 Edwards ..... E21B 33/064 166/363
2012/0305258 A1* 12/2012 Baugh ..... E21B 33/064 166/344
2013/0112420 A1* 5/2013 Bisset ..... E21B 33/035 166/344
2013/0175045 A1* 7/2013 Rytlewski ..... E21B 33/0355 166/363
2013/0299177 A1* 11/2013 Lyle ..... E21B 43/0122 166/338

FOREIGN PATENT DOCUMENTS

WO WO 2008/074995 6/2008
WO WO 2008074995 A1 * 6/2008

* cited by examiner

SUBSEA PUMP SYSTEM

This Application is the U.S. National Phase of International Application Number PCT/GB2012/050520 filed on Mar. 8, 2012, which claims priority to Great Britain Application No. 1104021.9 filed on Mar. 9, 2011.

FIELD OF INVENTION

The present invention relates to a pump system, and typically to a hydraulic pump system for subsea use.

BACKGROUND TO INVENTION

Subsea pump systems normally have a motor that drives a pump. The system, motor and pump are normally hydraulic or electro hydraulic. In an open-loop hydraulic drive system or circuit a hydraulic motor is used to drive the hydraulic pump that is used to move another fluid, often called a media fluid, which can be seawater, between a first and a second location. Existing systems such as these are used to close blowout preventer (BOP) rams.

Subsea pump systems having two pumps have been used in the past for closing BOP rams. Typically one of the pumps is a high flow pump and the other pump is a high pressure pump.

SUMMARY OF INVENTION

In general, there is provided a pump system comprising a first pump and a second pump configured to pump fluid media from a source to a target, and wherein the system has a controller configured to automatically operate at least one of the first and second pumps. Optionally the controller operates both of the pumps together, or operates one but not the other.

According to a first aspect of the invention, there is provided a subsea pump system adapted to close a hydraulic ram of a blowout preventer, the subsea pump system comprising a plurality of pumps including at least a first pump and a second pump configured to pump drive fluid from a source to the hydraulic ram, and wherein the system has a controller configured to automatically select at least one of the first and second pumps for pumping the drive fluid wherein at least the first pump is selected at a lower fluid pressure range and at least the second pump is selected at a higher fluid pressure range.

Advantageously, the drive fluid source comprises a fluid reservoir—this may be, for example, a bladder reservoir adapted for filling with seawater.

Typically the controller directs fluid media through the pumps. Typically the controller switches fluid flow between the two pumps automatically.

By using a pump system having two pumps, each pump can be selected to provide a specific function and therefore each pump can be operated at or close to its optimum efficiency.

Typically the pumps are hydraulic pumps and are driven by a drive fluid. Passage of the drive fluid through the pump, e.g. through a drive fluid circuit from a drive fluid reservoir, through a drive side of each pump and back to the reservoir, typically drives the pumping of the fluid media through a media side of the pump.

The pump system may be configured for use subsea. The drive fluid may be supplied from a remotely operated vehicle (ROV). The pump system may be colocated with the ROV, for example on a skid conveyed by the ROV, or it may be colocated at the BOP, for example in a capping stack disposed on the BOP.

Embodiments of the invention allow the more efficient use of limited hydraulic power from an ROV to operate subsea apparatus, which would ordinarily require a higher specification of hydraulic pump capable of delivering circa 150 lpm of hydraulic fluid at up to 450 bar (6526 psi).

The pump system having a first pump and a second pump typically provides a high flow pump and a high pressure pump. It is useful to have both high flow and high pressure capability, especially if the hydraulic system is to be used to activate a BOP.

The driven media can be any fluid. It is normally water and typically seawater. The media may be stored in a reservoir or if it is water, the fluid can be drawn from the water surrounding the ROV and hydraulic drive system. When the media is water a filter is used to help prevent solids or detritus in the water entering the driven side of the hydraulic drive system. Optionally driven media fluid can be sourced from both a reservoir and from seawater in the same embodiment.

Typically the first and second pumps have different optimal performance characteristics. Typically the pumps have different optimal pressure and flow characteristics, and typically the first pump can be adapted to pump fluid media with a high flow volume, e.g. at high flow rates. Typically the second pump can be adapted to pump fluid media at high pressure. Typically the first pump has a lower optimal pressure rating than the second pump.

The first and second pumps may be a hydraulic high pressure water pump supplied by Dynaset Oy (Ltd.).

Most hydraulic pumps are driven by a drive fluid used to pump a driven fluid medium having a range of pressures and flow rates and volumes at which the performance of the hydraulic pump is optimum. At pressures and/or flow rates outwith these ranges, pumps generally do not provide a maximum ratio of output/input. Embodiments of the present invention permit the design of pump systems which have different optimal operating ratios, for example a first pump with a high flow rate, e.g. high volumes of fluid passing through the pump per minute, but rated to a fairly low pressure, and a second pump having a typically low flow rate, e.g. lower volumes of fluid passing through the pump per minute, but capable of high pressure output. In certain embodiments, the pumps are linked in a circuit and are adapted to pump the same medium through the controller.

Typically the controller automatically changes power input or output of the two pumps in response to pressure or flow rate characteristics of the driven fluid media. In certain embodiments the controller automatically changes power input or output of the two pumps in response to pressure or flow rate characteristics of the drive fluid. For example, when the pressure of one of the driven or drive fluids exceeds the optimal working pressure of the first pump, the controller switches the pumping of the driven fluid media to the second pump, so that the second pump, which is typically capable of operating at higher pressures than the first pump, takes on more load of driven fluid media and reduces the load on the first pump.

In certain embodiments, the controller can comprise flow control elements in fluid communication with the output line of a pump. In other embodiments, the flow control elements can be in fluid communication with the inlet line of a pump. Typically both pumps have flow control elements on the same side of the pump, either inlet or outlet.

In one arrangement, the controller comprises balanced poppet valves.

Typically the switch over is initiated between the first and second pumps before the pressure (or other characteristic) threshold is reached, so that for a given overlap range of fluid characteristics (e.g. typically pressure), both pumps are operating. Optionally the two pumps can pump driven fluid media during the overlap range, although this is not necessary, and one pump can optionally be idling or cycling, and in some cases, one of the two pumps can be stalled so that no driven fluid media is passing through the stalled pump. Overlapping the operation of the pumps in a certain range of pressures or other fluid characteristics can help the pumps to reach their optimal operating speed before taking a significant amount of the load of the driven fluid.

Advantageously, in a system with balanced poppet valves, these valves are adapted to open at different pressures to define the overlap range.

Typically the overlap range of flow characteristics, in this case the fluid pressure, when both pumps are operating is between 1 and 200 psi, optionally 10 psi-100 psi, and typically within the range of pressures from 10 to 30 psi; in an alternative embodiment the difference in the pressure thresholds between the two pumps can be between 300 and 2000 psi.

A further advantage of having a range of flow rates and pressures over which both pumps operate is that the target is supplied with the necessary volume of fluid at the correct pressure in a shorter period of time.

Typically the controller diverts load away from the second pump in preference for the first pump when the flow rates of the driven fluid are below the optimal flow rates for the second pump. Typically the controller diverts load away from the first pump in preference of the second pump when the pressure of the driven fluid is below the optimal values for the first pump. The controller typically changes configuration between activated and deactivated when the pressure of one of the driven or drive fluids is outside a predetermined range.

In different arrangements, the inlet of the first pump and the inlet of the second pump may be arranged in series or in parallel.

Typically the driven fluid operates a hydraulic device. The hydraulic device can be any suitable device such as a hydraulic circuit on a wellhead of an oil or gas well. Typically the wellhead is a submerged wellhead. Typically the hydraulic device can require a long travel between two components but can also require a high performance (e.g. high pressure) engagement between the two components, and embodiments of the present invention are typically suitable for the operating of subsea BOPs on wellheads. Typically the rams of BOPs need to travel long distances to close off the production bore through the wellhead in order to ensure containment of the wellbore production fluids within the well, and also require a high pressure seal at the interface between the rams. Embodiments of the present invention allow the construction of a pump system that can deliver efficient rapid long travel while the rams of the BOP are being driven towards one another, and still permit high pressure driving of the rams against one another to form the high pressure seal at their interface. Other uses are however possible, such as pressure testing of gaskets or other fluid circuit components.

Optionally the controller can automatically change the input or output characteristics (e.g. the pressure or flow rate) of the two pumps during opening and closing. For example, while the rams of the BOP are closing together, the rams occasionally become jammed and need to overcome an obstacle or resistance to further movement. Typically the low pressure high flow rate first pump is not particularly suited to apply high forces to the rams in order to overcome the resistance to movement of the rams, and in such cases, the controller can automatically vary the output or input of the pumps to quickly overcome resistance using the high pressure low volume pump, which is typically able to overcome resistance as it can achieve a higher output pressure and can therefore apply a larger force to the rams. Typically once the resistance is overcome, the load is automatically transferred back to the high volume/high flow rate/low pressure pump to continue filling the ram chambers as quickly as possible using the first pump.

Typically the controller switches between the pumps over a range of pressures of the driven fluid media, resulting in the operation and loading of both of the pumps during the overlap transition, which allows a smoother control of transition between the two pumps when the pressure increases.

Optionally the controller comprises a fluid conduit diverting fluid from the inlet or the outlet of each of the pumps, and a valve device adapted to close or open the conduits. The valve device can comprise a number of valves adapted to react to pressure or other fluid characteristics within the conduit in order to open the valve and initiate the diversion of fluid (and therefore load) between the two pumps.

Optionally the pumps can be connected in the same circuit and the driven fluid can flow through each of the pumps in series. Optionally the drive fluid sides of the pumps can be connected on the same circuit but the driven side of the pumps can be arranged in parallel.

Typically the controller comprises a valve in fluid communication with the drive fluid or the driven fluid circuit. The valve typically has an inlet and an outlet and a closure device such as a spring against which typically the fluid pressure of the drive fluid or driven fluid is exerted. The closure device typically holds the valve in one configuration, e.g. normally open or normally closed. The pressure required to compress the spring, e.g. thereby providing fluid communication between the inlet and the outlet of the valve, depends on the strength of the spring. The spring rate can be changed and therefore compressibility can be tailored to the specific pressure of the drive fluid or driven fluid at which the valve must open and provide fluid communication between the inlet and the outlet.

According to one embodiment, using two pumps, a high flow (HF) pump and a high pressure (HP) pump, the pumps can be connected together in series. Hydraulic power can be routed to the HF pump initially, and the output from this pump can be fed to the HP pump. The driven media output of the HP pump typically runs through a valve to ensure that when high pressure output is not required the pump will "freewheel" dropping all output fluid media back to the media reservoir. Therefore the HP pump cycles and draws minimum power from the system and allows the HF pump to run at its full potential. When the output pressure reaches the maximum set pressure for the HF pump a second valve can open dropping the output flow to the media reservoir, and the HF pump then idles and draws minimal power from the system. The logic valve on the HP output will also close at this point allowing the system to output at high pressure. If the output pressure drops below the maximum pressure for the HF pump, the logic valves are typically adapted to reverse and the system will again deliver driven media at high flow rates. This embodiment can typically switch between outputs continually to optimise flow throughout the closure of the rams.

Optionally the pump system has more than two pumps, for example, a high flow (HF) pump and two or more high pressure (HP) pumps. Alternatively the pump system has a high pressure (HP) pump and two or more high flow (HF) pumps. Different combinations of high pressure (HP) and/or high flow (HF) pumps are envisaged. By having more than one HF or HP pump the output of the pump system can be tailored to operate a particular tool or have a particular mode of operation.

In a further aspect, the invention provides an intervention skid for attachment to a remotely operated vehicle (ROV) for interaction with a blowout preventer (BOP), the intervention skid comprising at least the plurality of pumps of a pump system as set out above. Such an intervention skid may further comprise the fluid reservoir of such a pump system.

In a still further aspect, the invention provides a method of operating a hydraulic ram of a subsea blowout preventer on an oil or gas well, the method comprising pumping a drive fluid to operate the hydraulic ram, wherein the drive fluid is pumped by a subsea pump system comprising a plurality of pumps comprising at least a first pump and a second pump, and during pumping of the drive fluid automatically selecting at least one of the first and second pumps for pumping the drive fluid wherein at least the first pump is selected at a lower fluid pressure range and at least the second pump is selected at a higher fluid pressure range.

Advantageously, the lower fluid pressure range and the higher fluid pressure range overlap, and including automatically selecting operation of both of the pumps to deliver the drive fluid where the fluid pressure ranges overlap. Preferably, the method includes automatically changing the load of the first and second pumps during opening and closing of the hydraulic ram.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

BRIEF DESCRIPTION OF FIGURES

Various embodiments and aspects of the invention will now be described in detail, by way of example, with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa.

All numerical values in this disclosure are understood as being modified by "about". All singular forms of elements, or any other components described herein are understood to include plural forms thereof and vice versa.

Figure 1:
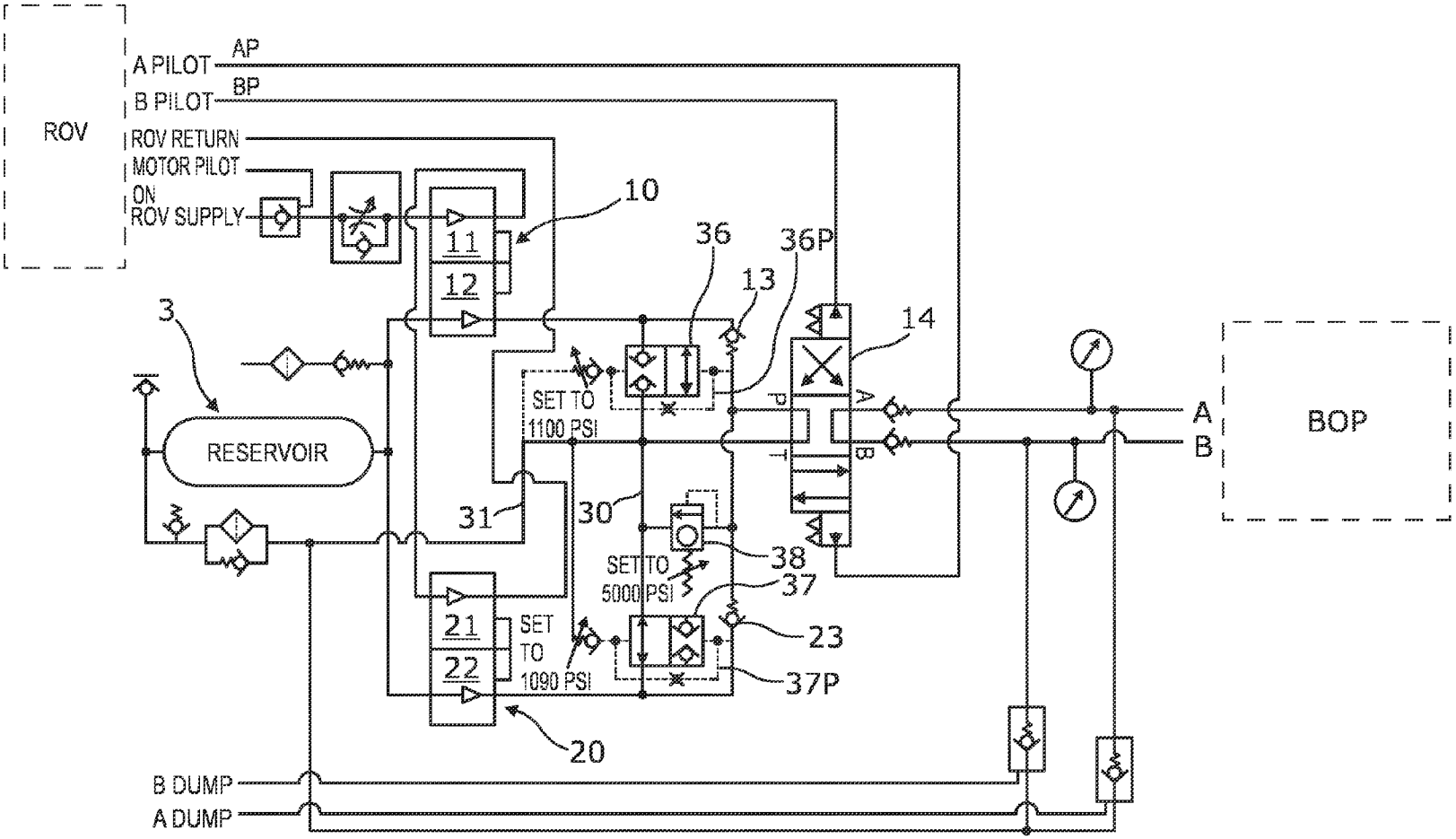
Figure 2:
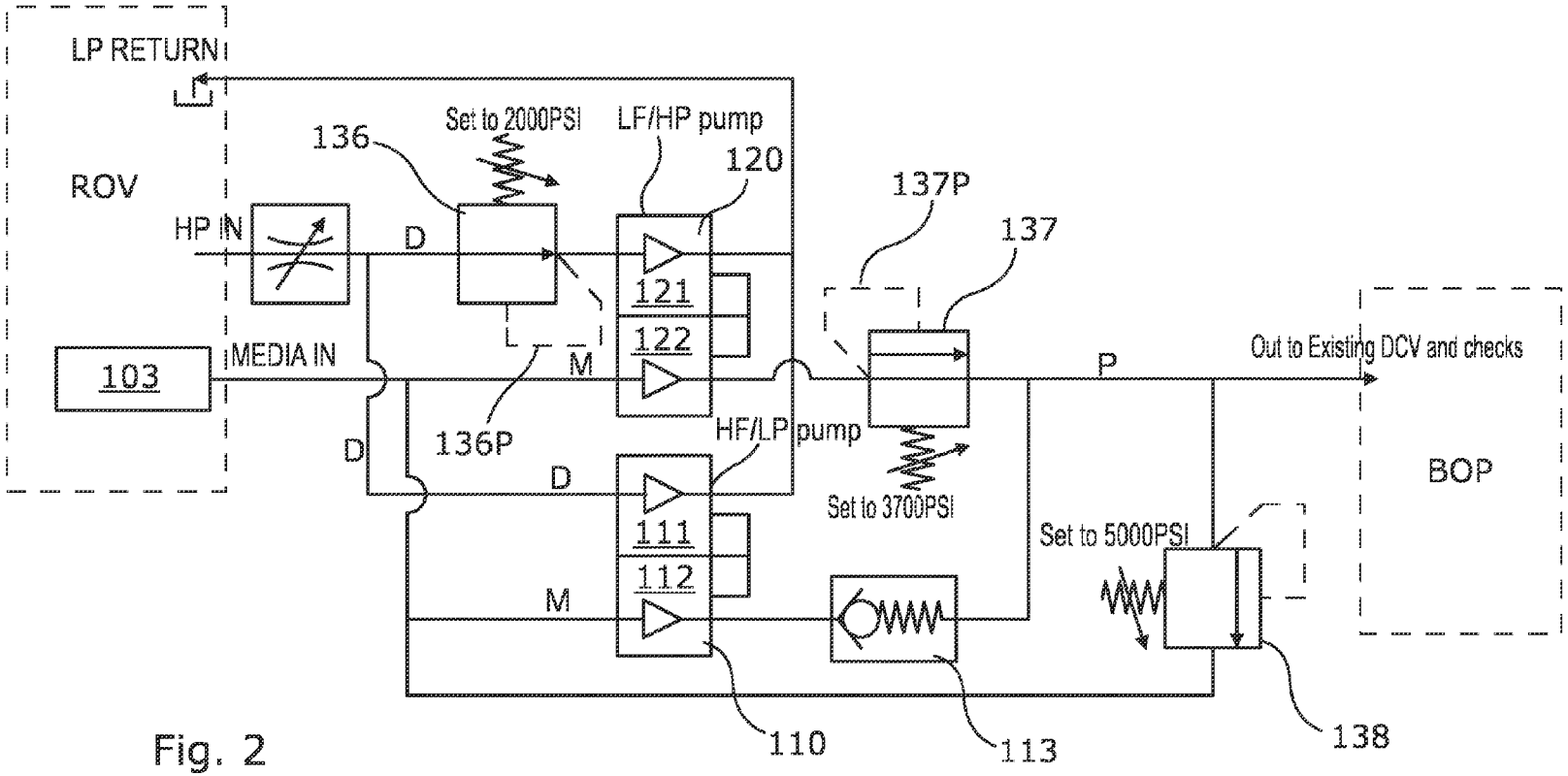
Figure 3:
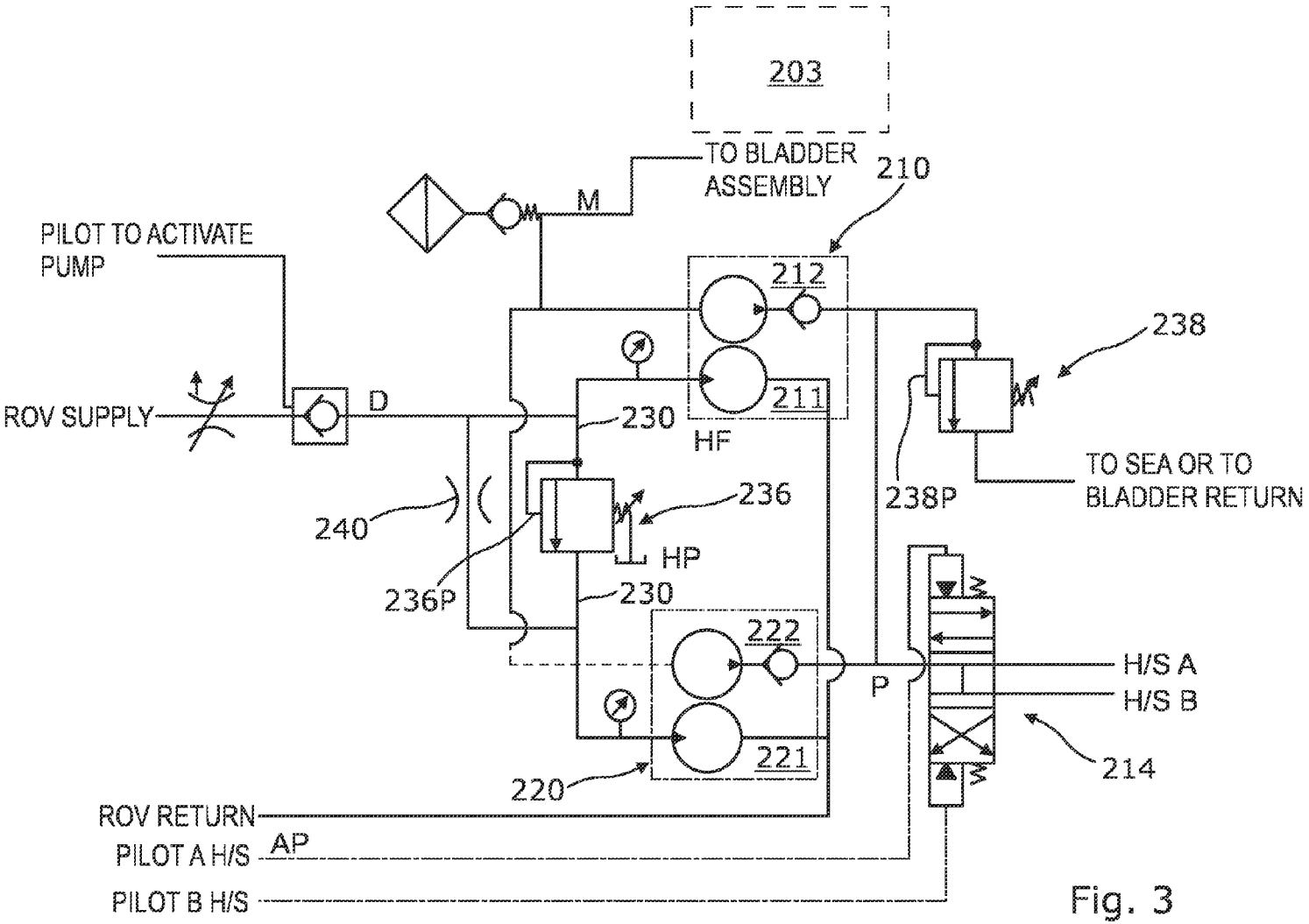

In the accompanying drawings:

FIG. 1 shows a schematic diagram of a first embodiment of a pump system according to the invention;

FIG. 2 shows a schematic diagram of a second embodiment of a pump system according to the invention; and FIG. 3 shows a schematic diagram of a pump system according to a third embodiment of the invention.

DETAILED DESCRIPTION OF SPECIFIC EMBODIMENTS

Referring now to the drawings, each of the drawings shows a separate pump system for an ROV (remotely operated vehicle) typically used to operate the rams of a BOP (blowout preventer).

A first embodiment of the invention is described with reference to FIG. 1. This pump system has a first pump 10 and a second pump 20. The pumps 10, 20 are hydraulic pumps each having a drive side 11, 21 which is driven by the flow of drive fluid supplied by the ROV or from another source, and a driven media side 12, 22 respectively. The driven media sides 12, 22 pump a driven fluid media from a reservoir into a target which in this embodiment comprises one or more hydraulic chambers in the rams of the BOP. The various embodiments have in common that they allow switching of the pumps automatically, so that one pump (typically the high flow pump) is used to quickly fill the chamber of a ram with hydraulic fluid (driven media) and then the high pressure pump can be used to give the final squeeze of the ram to obtain a high pressure high performance seal that might not be achievable by the low pressure high volume first pump. In other embodiments, multiple pumps may be used to provide redundancy or to provide further gradations in performance over the pressure range of operation of the system.

The pump system is described here as separate from both the ROV and the BOP. In principle, the pump system may be colocated with the ROV (or even formed within it) or colocated with the BOP (for example, formed within a capping stack of the BOP). A particularly preferred solution is for the pump system to be deployed on an intervention skid. An intervention skid is a modular unit which may be deployed with an ROV for use in making an intervention on an installed flow system.

The reservoir 3 may be a bladder assembly—this may be mounted on the ROV, or in a preferred solution, mounted on an intervention skid with the pump system. Advantageously, seawater is used as the pump drive medium, and the bladder assembly can be filled from seawater (with appropriate filtration in the filling system).

The drive side 11 of the first pump 10 is supplied by hydraulic fluid from the ROV through a check valve and a pressure compensated flow control valve. The outlet of the drive side 11 feeds the inlet of the drive side 21 on the second pump, so that the pumps 10, 20 are effectively in series on their drive sides. The outlet of the drive side 21 of the second pump is returned to the ROV reservoir of drive fluid. Passage of drive fluid through the circuit from the ROV drive fluid reservoir through the drive sides 11, 22 drives the pumps 10, 20 respectively to pump driven media from a reservoir 3, which can optionally be located on the ROV, or on a separate skid if desired.

Whereas the drive sides 11, 21 of the pumps 10, 20 are connected in series, the drive media sides 12, 22 of the pumps 10, 20 respectively are connected in parallel to the reservoir 3, which feeds the inlet of each driven media side 12, 22. The outlet of the driven media side 12 of the first pump 10 is routed through a non-return check valve 13, and passes through a pilot directional switch 14 which can typically be controlled from the ROV. The directional control switch diverts the driven media fluid between send and return lines A or B in the BOP, depending on the direction of hydraulic fluid to be pumped into the BOP. The send and return lines A, B typically have check valves and gauges to control and monitor flow rates and pressures in the send and return lines A, B.

Pilot directional control switch is auxiliary to pump systems according to embodiments of the invention. In some embodiments, the output of the pump system may be provided directly to the BOP, rather than through a switch such as pilot directional control switch 14. In other applications of a pump system of this type, such as pressure testing, a control switch such as pilot directional control switch 14 will be more generally used. Where no pilot directional control switch 14 is used, activation of the switch from the ROV is consequently also not required.

The pilot directional control switch 14 is shown in the drawings in the intermediate position, but pressure applied to the switch 14 through an activation pilot line AP moves the switch body to send fluid from the reservoir 3 through the driven media side 12 of the first pump 10, through the send line P and check valve 13 and into the send line A in order to deliver the fluid under pressure to the BOP. The directional control switch 14 can be reversed by applying pressure through pilot line BP in order to move the switch body 14 back and connect the driven side 12 of the first pump 10 to the feed line B by means of the cross-over in the switch body 14.

The driven side 22 of the second pump 20 is fed from the same reservoir 3 and the outlet from the driven side 22 is fed through a check valve 23, similar to the check valve 13, in order to supply fluid to the same inlet line P to the directional control switch 14. Thus, the second pump 20 also receives fluid from the reservoir 3 through the inlet on the driven side 22, feeding it through the send line P, the check valve 23 and into the send or return lines A or B depending on the configuration of the directional control switch 14.

The operation of the two pumps 10, 20 is selectively controlled by a controller in the form of a jumper line 30 connecting the outlet lines from the driven sides 12 and 22 of the first and second pumps 10, 20. The jumper line 30 incorporates a normally closed balanced poppet valve 36, and a normally open balanced poppet valve 37. The jumper line 30 is spliced to the fluid return line T on the ROV side of the directional control switch 14. A safety relief valve 38 is connected between the send line P and the jumper line 30. The return line T from the BOP downstream from the directional control switch delivers fluid through a return filter 8 and a pressure relief valve 9 back to the reservoir 3.

The balanced poppet valves 36 and 37 are activated by pilot lines 36*p*, 37*p*, which connect the poppet valves 36*p*, which respectively connect the poppet valves 36, 37 to the send line P. The pilot line 37*p* is connected before the check valve 23, and the pilot line 36*p* is connected after the check valve 13. Accordingly, pilot line 36*p* relays pressure prevailing at the fluid send line P, whereas pilot line 37*p* relays pressure that prevails at the outlet of the driven side 22 of the second pump 20. Typically, the poppet valves 36, 37 are set to change configuration at certain thresholds. Typically the threshold for the poppet valve 36 is set at a higher pressure than the threshold for poppet valve 37, so that poppet valve 37 begins to close shortly before poppet valve 36 begins to open. Accordingly the two valves 36, 37 are both open for a short period between the threshold pressures allowing operation of each of the pumps in tandem with one another. When poppet valve 36 is closed as shown in the Figures, fluid is sent from the reservoir 3 through the driven media side 12 of the first pump 10, through the check valve 13 and into the send line P leading to the BOP in a direction dependent on the directional control switch 14. When valve 36 is closed as shown in FIG. 1 valve 37 is typically open, and the second pump 20 therefore drives fluid from the reservoir 3 through the driven media side 22 of the second pump, and through the jumper line 30, where it is diverted through the intersection between the jumper line 30 and the fluid send line T and is routed through the return line 31 back to the reservoir 3.

This is the prevailing operational system at low fluid pressures, typically set by the thresholds of the balanced poppet valves 36, 37. When the pressure is below the threshold of the poppet valve 37, the first pump 10 configured to operate at low pressure but to deliver high volumes, typically drives all of the fluid through the send line P to the BOP, and typically takes all of the load. The second pump simply cycles driven media through the jumper line 30 and return line 31 back to the reservoir 3 without taking any substantial load to drive the fluid to the BOP. Typically the first pump 10 has a particular ratio between the drive and media sides, and operates best at low pressures where it can pump high volumes very quickly and efficiently. The poppet valves 37 and 36 are typically set to change configuration at about the upper threshold of effective operation of the first pump 10. Above that threshold (approximately 1100 psi or 75.8 bar) the first pump is capable of fairly efficient operation, whereas the second pump is typically rated at a different ratio and is typically adapted to pump low volumes of fluid at high pressure. Using the second pump 20 to pump high volumes of fluid is inefficient because it is relatively slow due to its inherent characteristics, but the second pump is typically extremely efficient at quickly pumping low volumes of fluid at high pressures. Therefore, at the trigger pressure of 1090 psi or 75.1 bar, the poppet valve 37 shifts configuration to close off the fluid communication between the jumper line 30 and the second pump 20, therefore rerouting the fluid media driven from the driven side 22 of the second pump through the check valve 23 and into the inlet of the send line P, and then to the BOP as previously described. The same pressure threshold prevailing between the check valves 13, 23, opens the normally closed poppet valve 36 at around 1100 psi or 75.8 bar, which therefore diverts the driven fluid media from the first pump through the jumper line 30 and the return line 31 back to the reservoir 3. Accordingly, the jumper line 30 with its poppet valves 36, 37 automatically switches the driven fluid between the outlets of the pumps 10 and 20 dependent on the fluid pressure in the driven fluid being sent to the BOP, ensuring that at any given fluid pressure, the fluid is being pumped efficiently by a pump suited to pump at that pressure. Setting the valves 36, 37 at different threshold pressures enables concurrent operation of the two pumps during the transition phase between 1090 and 1100 psi, so that between the pressure thresholds the two pumps are operating together and at the initiation of its operation, the second pump is not bearing all of the load and is therefore less likely to perform below its optimal capabilities. Typically it is advantageous to keep the difference in the threshold between the two pumps low; typically the most efficient system is one with very little overlap, which makes maximum use of the high volume high flow rate output of the first pump up to the point just before it begins to stall.

It is also advantageous that while the first pump 10 is bearing the load at low pressures, the second pump 20 is cycling although not under load as it is driving the fluid through the jumper line 30 and return line 31 back to the reservoir, and so at the transitional pressures when the poppet valves 36 and 37 are changing configuration to use the second pump 20 rather than the first pump 10, the second pump is already operating at conditions that approach optimal flow rates, pumps speeds and fluid pressures, and this allows for smoother transition between the loads borne by the two pumps.

The safety relief valve 38 is connected across the high pressure poppet valve 37 and is typically rated to around 5000 psi (345 bar), so that if the pressure in the send line P exceeds that value, the pressure relief poppet valve 38 opens in order to dump fluid through the jumper line 30 and from there to the return line 31 and back to the reservoir. The threshold of the safety relief valve in any particular system is can typically be varied up to the maximum output pressure of the HP pump. 5000 psi (345 bar) is a typical value for this system but could be varied in other embodiments. It should be noted that this is a safety feature for practical use, rather than a fundamental part of the design.

Dump valves 13 are connected to the send and return lines A, B after the directional control switch 14 and are activated by pilot lines in order to allow dumping of fluid from the send and return lines A and B while bypassing the fluid circuit.

In summary, the first embodiment enables pumping of up to 150 lpm of drive fluid at a pressure of up to 450 bar (6526.6 psi) using the combination of the two pumps. This allows the system to be used to close BOP rams efficiently, using only the limited power available from the majority of common work class ROV systems. Automatic switching between both pumps allows optimised output of each circuit.

This embodiment allows a reliable method of gaining the flows and pressures necessary for utilising the available power from a standard work class ROV, without requiring user intervention while operating the BOP, reducing the risks of human error and reducing closing times. Also, the system can be lighter and smaller than pumps available to offer the same outputs, and as a result of the automatic switching the system can also operate using lower power sources of drive fluid.

Referring now to FIG. 2, a second embodiment will now be described which has various features in common with the first embodiment. For ease of reference, the same reference numerals will be used, increased by 100. With reference to the second embodiment of the pump system as shown in FIG. 2, the pump system has a first pump 110 and a second pump 120. Typically the first pump 110 has a particular ratio adapted to pump high volumes of fluid at low pressures, and the second pump 120 typically has a different ratio and is adapted to pump lower volumes of fluids at high pressures. Each of the pumps 110, 120 is a hydraulic pump, and is driven on a drive side 111, 121 by high pressure hydraulic fluid supplied from an ROV. Typically, the drive sides 111, 121 of the pumps 110, 120 are connected in parallel, and are each fed from the reservoir of drive fluid (not shown) in the ROV. Optionally, the reservoir can be provided on a separate skid if desired. The driven media sides 112, 122 of the pumps 110, 120 are connected in parallel to a driven fluid media reservoir 103, optionally located on the ROV, but this could typically be provided in a different location.

The inlet of the drive side 120 of the second pump 120 is provided with a normally open pressure reducing valve 136, which is activated by a pilot line 136*p* which relays pressure that prevails on the outlet side of the valve 135. The valve 136 is set to change configuration from normally open to close at a threshold in the drive fluid of around 2000 psi. Below that threshold, the valve 136 is normally open, and permits flow of drive fluid into the inlet of the second pump 120.

Accordingly, at pressures below 2000 psi in the drive fluid, the fluid is directed through each of the pumps 110, 120 which are connected in parallel. The outlet of the driven fluid media side 112 of the first pump 110 has a non-return check valve 113 between the pump 110 and the send line P delivering pressurised fluid to the BOP. The outlet of the driven media side of the second pump 120 has a normally closed poppet valve 137 connected between the pump 120 and the junction with the outlet line from the first pump 110, and therefore at low pressures below the threshold of 3700 psi in the driven fluid media, the second HP/LF pump 120 does not deliver pressurised drive fluid media to the BOP. The valve 137 provides the controller for the system of this embodiment; it is normally closed and is rated to open at around 3700 psi in response to input pressure in the driven media fluid.

The input pressure required by the second pump 120 to overcome the 3700 psi holding the valve 137 closed will be around 1400 psi due to an intensifier ratio in the second pump 120 of around 2.62. Until the output of the first pump 110 is over around 800 psi the first pump 120 is the path of least resistance and the hydraulic drive fluid will flow through it rather than through the second HP pump 120.

When the output pressure of the first HF/LP pump 110 rises above the 800 psi threshold the input pressure in the drive fluid feeding both pumps is above the 1400 psi needed to work the HP/LF second pump 120 (the intensifier ratio of the HF/LP first pump is around 0.52) and the second pump 120 will then begin to pump driven media through it. There will be a transition period when both pumps 110, 120 operate in parallel to pump driven media fluid from the reservoir 103 through their media sides 112, 122 through the valves 113 and 137 and into the send line P for delivery under pressure to the BOP. As the pressure increases, the HF/LP first pump 110 will stall, but only after the HP/LF second pump 120 has taken over the load of the driven media. If the output pressure drops back below the 800 psi threshold the HF/LP first pump 110 will start up again, ensuring at least one of the pumps is operating as the pressures change.

Accordingly, at low pressures, the first high flow/low pressure pump 110 is operated to pump driven media fluid from the reservoir 103 through the driven media side 112 of the first pump 110 through the check valve 113 and into the send line P for delivery under pressure to the BOP.

At higher pressures, the valve 137 opens in order to allow flow through the second pump 120, and for a transitional range of pressures, both pumps operate, until the first pump 110 reaches its stalling pressure.

The pressure reducing valve 136 closes at input pressure in the drive fluid above 2000 psi, which will divert drive fluid away from the high pressure low flow second pump 120 towards the high flow/low pressure first pump 110.

The system has a safety valve 138 connected to the send line P downstream of the valves 113 and 137. The safety valve 138 is normally closed but is rated to open at a threshold pressure of 5000 psi in the send line P and can be arranged either to dump fluid to sea, or to recirculate it back to the reservoir 103 as required.

Typically the low pressure pump is operating at close to its optimal capacity before the second pump is activated, and once the high pressure second pump 120 is under full load, it is already operating at close to optimal capacity. This gets the high pressure second pump 120 close to optimal operating conditions it bears all of the load. Manipulating of the two pressure thresholds of the poppet valves 136, 137 can be useful in order to match the performance characteristics of the high pressure and low pressure pumps. Typically, the low pressure pump 110 is adapted to pump large volumes of fluid under low pressure. The high pressure pump 120 is typically adapted to pump lower volumes of fluid at higher pressures.

The 3700 psi relief on the output side of the second HP pump 120 ensures that the first HF pump 110 is the path of least hydraulic resistance at low pressures. Once the pumps have been energised the HP pump will immediately try to run but will dead head against the 3700 psi relief until the first HF pump 110 approaches its maximum pressure, and at this point the back pressure through the first HF pump 110 will be greater than the pressure required for the second HP pump 120 to overcome the 3700 psi relief valve so the second HP pump 120 will take over and give a high pressure output. If at any stage the pressure drops back down, (e.g. if the pipe has sheared causing the rams to move quickly together and the pressure in the chamber to dip suddenly) then the first LP pump 110 will immediately start again which smoothes out the operating transitions between the two pumps.

Referring now to FIG. 3, a modified pump system is disclosed which typically has certain features in common with the earlier described embodiments. The third embodiment therefore uses the same reference numbering but with the numerals increased by a further 100. The pump system of the third embodiment therefore has a first pump 210 and a second pump 220. The pumps 210, 220 are again hydraulic pumps each having a drive side 211, 221 which is driven by the flow of drive fluid supplied by the ROV or optionally from another source, and a driven media side 212, 222 respectively. The driven media sides 212, 222 pump a driven fluid media from a reservoir into the rams of the BOP as previously described.

The drive sides of the pumps 210 and 220 are connected in parallel with the drive fluid reservoir. The drive side 211 of the first pump 210 is supplied by hydraulic fluid from the ROV through a check valve and optionally a pressure compensated flow control valve. The outlets of the drive sides 211 and 221 are connected to return the drive fluid to the ROV reservoir of drive fluid. Passage of drive fluid through the circuit from the ROV drive fluid reservoir through the drive sides 211, 221 drives the pumps 210, 220 respectively to pump driven media from a bladder reservoir 203, which can optionally be located on the ROV, or on a separate skid if desired.

The driven media sides 212, 222 of the pumps 210, 220 respectively are connected in parallel with the reservoir 3, which feeds the inlet of each driven media side 212, 222. The outlets of the driven media sides 212, 222 pass through check valves and are connected together at a junction with a common send line P, and driven fluid media passes through a pilot directional switch 214 which can typically be controlled from the ROV. The directional control switch 214 typically diverts the driven media fluid between send and return lines A or B in the BOP, depending on the direction of hydraulic fluid to be pumped into the BOP. The send and return lines A, B typically have check valves and gauges to control and monitor flow rates and pressures in the send and return lines A, B. As for the FIG. 1 embodiment, use of a control switch such as directional control switch 214 is optional, and the output of the pump system may be provided directly to the BOP in embodiments where such a control switch is not used.

The directional control switch 214 is shown in FIG. 3 in the intermediate position, but pressure applied to the switch 214 through an activation pilot line AP moves the switch body to send fluid from the reservoir 203 through the driven media side 212 of the first pump 210, through the send line P and directional control switch 214 and into the BOP send line A in order to deliver the fluid under pressure to the BOP. The directional control switch 214 can be reversed by applying pressure through pilot line BP as previously described.

The driven media side 222 of the second pump 220 is fed from the same reservoir 203 and the outlet from the driven side 22 is fed through a check valve to supply driven media fluid to the same send line P feeding the directional control switch 14. Thus, the second pump 220 also receives fluid from the reservoir 203 through the inlet on the driven side 222, feeding it through the send line P and into the send or return lines A or B depending on the configuration of the directional control switch 14.

The operation of the two pumps 210, 220 is selectively controlled by a flow controller in the form of a jumper line 230 connecting the inlet lines from the drive fluid sides 211 and 221 of the first and second pumps 210, 220.

The inlet of the drive side 221 of the second pump 220 also has a flow restriction 240 in the form of a bleed orifice which allows a very small flow of fluid to be supplied to the second pump 220 to stop damage to the second pump in the event of rapid deactivation—this is an optional part of the design, and is in particular not necessary when the second pump 220 is of a type which is not susceptible to damage on rapid deactivation. The jumper line 230 incorporates a normally closed balanced poppet valve 236. The jumper line 30 is spliced across the inlets of the drive fluid sides 221 and 211 on the ROV side of the pumps 210, 220. A safety relief valve 238 is provided on a branch of the outlet from the driven media side of the first pump 210, after the check valve, and can dump fluid to the sea or return it to the bladder 203.

The balanced poppet valve 236 is activated by a pilot line 236*p*, which relays pressure prevailing at the inlet to the drive side of the first pump 210. Typically, the poppet valve 236 is normally closed and is set to change configuration at a threshold of 80 bar (around 1160 psi). When poppet valve 236 is closed as shown in the Figures, drive fluid sent from the ROV is routed through the drive fluid sides of the two pumps 210, 220 at the same time, but because of the flow restriction 204 the path of least resistance is through the first pump 210, which is driven to pump fluid media into the send line P leading to the BOP in a direction dependent on the directional control switch 14. Thus below the pressure threshold of 80 bar, only the first pump 210 is operating, as the small amount of fluid reaching the drive fluid inlet of the second pump through the flow restriction 204 is not sufficient to operate the second pump 220.

This is the prevailing operational system at low fluid pressures, typically set by the threshold of the balanced poppet valves 236, when the pressure is below the threshold of the valve 236. Typically the first pump 210 operates best at low pressures where it can pump high volumes very efficiently. The valve 236 is typically set to change configuration at about the upper threshold of effective operation of the first pump 210. The second pump is typically rated at a different ratio and is typically adapted to pump low volumes of fluid at high pressure. Using the second pump 220 to pump high volumes of fluid alone is inefficient because of its inherent characteristics, but the second pump is typically extremely efficient at pumping low volumes of fluid at high pressures. Therefore, at the trigger pressure of around 80 bar (around 1160 psi) the valve 236 shifts configuration to open a channel of fluid communication to the second pump 220, therefore rerouting the drive fluid to the second pump 220, so that for a short range of pressures, both pumps 210, 220 are operating in parallel. Parallel operation of both pumps continues until at a certain pressure threshold, the first pump 210, being a HF/LP pump, stalls and all of the load is borne by the second HP/LF pump, but at that point, the second pump 220 is already operating at close to optimal capacity. Accordingly, the jumper line 230 with its controller in the form of the jumper line 230 with valve 236 automatically switches the drive fluid between the inlets of the pumps 210 and 220 dependent on the fluid pressure in the drive fluid being sent to the pumps, ensuring that at any given fluid pressure, the fluid is being pumped efficiently by a pump (or by more than one pump) suited to that pressure.

The safety relief valve 238 is typically rated to around 5000 psi, so that if the pressure in the send line P exceeds that value, the pressure relief poppet valve 38 opens in order to dump fluid to the sea or back to the reservoir.

This embodiment permits the advantages that high flow rates of up to around 150 lpm at pressures of up to 430 bar can be achieved in subsea use with hydraulic power sources from the majority of existing work class ROV's.

In this embodiment the HP pump is initiated only when higher pressure is required to finalise the closing of the BOP rams. During closing the system can automatically vary the output to quickly overcome resistance.

As discussed above, the principles employed may be used here in pump systems that comprise more than two pumps. For a third (or further) pump to be added, modifications would be required at the inlet side and the return side in each embodiment. This will be briefly described with respect to the FIG. 3 embodiment. On the return side, the position is straightforward—for any new pump, it is only necessary to add a further parallel channel identical to the return channel for the first pump and the return channel for the second pump, with the return lines meeting at point P. On the input side, an additional jumper line 230 and poppet valve 236 will be required for each pump, but the same principles will be employed—flow restrictions will be used on higher pressure pumps to favour the lower pressure pump initially, with valve values selected so that different pumps will take the pumping load over different pressure ranges.

One advantage of certain embodiments of the invention is that the system provides for continuous flow during the transition between the two pumps, typically in each direction of flow. Therefore, transitions between the two pumps can be smoother. Typically where the controller comprises a pair of valves set with different pressure thresholds, the thresholds are set (by adjusting the spring rate etc) in order to provide an overlap phase when both pumps are operating and flow is uninterrupted.

This pump system has applications other than the sealing of BOP rams. For example, the reliable provision of pressure over different pressure ranges, including high pressures, renders it particularly suitable for pressure testing of gaskets and other system components.

Modification and improvements can be incorporated without departing from the scope of the invention.

The invention claimed is:

1. A subsea pump system adapted to close a hydraulic ram of a blowout preventer, the subsea pump system comprising a plurality of pumps including at least a first pump and a second pump configured to pump a driven fluid from a driven fluid source to the hydraulic ram, each of the first and second pumps having a drive side configured to drive the pump, each drive side being fed drive fluid from a drive-fluid source, and a driven fluid side, each driven fluid side being configured to feed driven fluid to the same hydraulic ram, and wherein the subsea pump system has a controller adapted to select at least one of the first and second pumps for pumping the driven fluid to the hydraulic ram by selectively feeding fluid from the drive fluid source to the drive side of the at least one of the first and second pumps, wherein the first pump is adapted to pump driven fluid at higher flow rates than the second pump, and wherein the second pump is adapted to pump driven fluid at higher pressures than the first pump, whereby the controller is configured to feed drive fluid to at least the drive side of the first pump to activate the first pump hydraulically at a lower fluid pressure range and the controller is adapted to feed drive fluid to at least the drive side of the second pump to activate the second pump hydraulically at a higher fluid pressure range.

2. The subsea pump system as claimed in claim 1 wherein the driven fluid source for the subsea pump system comprises a fluid reservoir.

3. The subsea pump system as claimed in claim 2 wherein the fluid reservoir comprises a bladder reservoir adapted for filling with seawater.

4. The subsea pump system as claimed in claim 1, wherein the controller directs the drive fluid through the first and second pumps.

5. The subsea pump system as claimed in claim 1, wherein the controller switches fluid flow between the first and second pumps in response to changes in fluid pressure.

6. The subsea pump system as claimed in claim 1, wherein the first and second pumps are hydraulic pumps driven by the drive fluid supplied from a remotely operated vehicle (ROV).

7. The subsea pump system as claimed in claim 1, wherein the controller comprises one or more valves in fluid communication with an input line of one of the first and second pumps.

8. The subsea pump system as claimed in claim 7, wherein the controller comprises balanced poppet valves.

9. The subsea pump system as claimed in claim 1, wherein there is an overlap range between the lower fluid pressure range and the higher fluid pressure range, wherein in the overlap range both of the first and second pumps operate at the same time.

10. The subsea pump system as claimed in claim 8, wherein there is an overlap range between the lower fluid pressure range and the higher fluid pressure range, wherein in the overlap range both of the first and second pumps operate at the same time, and wherein the balanced poppet valves are adapted to open at different pressures to define the overlap range.

11. The subsea pump system as claimed in claim 10, wherein within the overlap range, one of the first and second pumps is configured for idling or cycling without providing the driven fluid to the hydraulic ram.

12. The subsea pump system as claimed in claim 1, wherein an inlet of the first pump and an inlet of the second pump are connected in parallel.

13. An intervention skid for attachment to a remotely operated vehicle (ROV) for interaction with a blowout preventer (BOP), the intervention skid comprising at least a plurality of pumps of a subsea pump system adapted to close a hydraulic ram of the blowout preventer, the subsea pump system comprising the plurality of pumps including at least a first pump and a second pump configured to pump driven fluid from a driven fluid source to the hydraulic ram, each of the first and second pumps having a drive side configured to drive the pump, each drive side being fed drive fluid from a drive-fluid source, and a driven fluid side, each driven fluid side being configured to feed driven fluid to the same hydraulic ram, and wherein the subsea pump system has a controller adapted to select at least one of the first and second pumps for pumping the driven fluid to the hydraulic ram by selectively feeding fluid from the drive fluid source to the drive side of the at least one of the first and second pumps, wherein the first pump is adapted to pump driven fluid at higher flow rates than the second pump, and wherein the second pump is adapted to pump driven fluid at higher pressures than the first pump, whereby the controller is configured to feed drive fluid to at least the drive side of the first pump to activate the first pump hydraulically at a lower fluid pressure range and the controller is adapted to feed drive fluid to at least the drive side of the second pump to activate the second pump hydraulically at a higher fluid pressure range.

14. The intervention skid as claimed in claim 13 further comprising a fluid reservoir of the subsea pump system.

15. A method of operating a hydraulic ram of a subsea blowout preventer on an oil or gas well, the method comprising pumping a driven fluid to operate the hydraulic ram, wherein the driven fluid is pumped by a subsea pump system comprising a plurality of pumps including at least a first pump and a second pump configured to pump a driven fluid from a driven fluid source to the hydraulic ram, each of the first and second pumps having a drive side configured to drive the pump, each drive side being fed drive fluid from a drive-fluid source, and a driven fluid side, each driven fluid side being configured to feed driven fluid to the same hydraulic ram, wherein the first pump is adapted to pump driven fluid at higher flow rates than the second pump, and wherein the second pump is adapted to pump the driven fluid at higher pressures than the first pump, and wherein during pumping of the driven fluid, the method comprises selecting at least one of the first and second pumps for pumping the driven fluid to the hydraulic ram by selectively feeding fluid from the drive fluid source to the drive side of the at least one of the first and second pumps, wherein at least the first pump is selected at a lower fluid pressure range and at least the second pump is selected at a higher fluid pressure range.

16. The method of operating a hydraulic ram as claimed in claim 15, wherein the lower fluid pressure range and the higher fluid pressure range overlap, and including automatically selecting operation of both of the first and second pumps to deliver the drive fluid where the fluid pressure ranges overlap.

17. The method of operating a hydraulic ram as claimed in claim 15, including automatically changing the load of the first and second pumps during opening and closing of the hydraulic ram.

18. The subsea pump system as claimed in claim 3, wherein the controller directs drive fluid through the first and second pumps.

19. The subsea pump system as claimed in claim 18, wherein the controller switches fluid flow between the first and second pumps in response to changes in fluid pressure.

* * * * *